US007584784B2

(12) United States Patent
Wagner

(10) Patent No.: US 7,584,784 B2
(45) Date of Patent: Sep. 8, 2009

(54) RECIPROCATING PUMP DRIVE APPARATUS

(76) Inventor: John Wagner, Box 178, Fox Valley, SK (CA) S0N 0V0

( * ) Notice: Subject to any disclaimer, the term of this patent is extended or adjusted under 35 U.S.C. 154(b) by 169 days.

(21) Appl. No.: 11/760,935

(22) Filed: Jun. 11, 2007

(65) Prior Publication Data

US 2008/0099211 A1 May 1, 2008

(30) Foreign Application Priority Data

Oct. 27, 2006 (CA) ..... 2566010

(51) Int. Cl.
*E21B 43/00* (2006.01)

(52) U.S. Cl. ..... 166/68.5; 166/105; 417/399; 60/372

(58) Field of Classification Search ..... 166/68.5, 166/105; 417/399; 60/369, 372
See application file for complete search history.

(56) References Cited

U.S. PATENT DOCUMENTS 2,874,641 A * 2/1959 McCandlish et al. ..... 166/62
4,430,924 A * 2/1984 Dunn et al. ..... 91/277
4,444,536 A * 4/1984 Brown ..... 414/22.56
4,497,616 A * 2/1985 Ratell, Jr. ..... 417/390
4,512,149 A 4/1985 Weaver
4,530,645 A 7/1985 Whatley et al.
4,761,120 A 8/1988 Mayer et al.
4,949,784 A 8/1990 Evans

* cited by examiner

*Primary Examiner*—Giovanna C Wright
(74) *Attorney, Agent, or Firm*—King & Schickli, PLLC

(57) ABSTRACT

A reciprocating drive apparatus for connection to a top end of a rod swing to drive a downhole pump located in a well includes a plate adapted to be fastened to a top end of a well head assembly of the well, and a mast attachable to the plate in a substantially vertical working position. A hydraulic cylinder is attached to the mast such that when the mast is in the working position the hydraulic cylinder is oriented substantially vertically, and such that the hydraulic cylinder can extend and retract in response to a controller. A tether is adapted to be fixed to the well head and to the top end of the rod string and is configured such that the hydraulic cylinder engages the tether to move the rod string up and down as the hydraulic cylinder extends and retracts.

20 Claims, 2 Drawing Sheets

RECIPROCATING PUMP DRIVE APPARATUS

This invention relates to pumps for pumping fluid from underground reservoirs, such as oil wells, and in particular to a reciprocating drive apparatus for a pump.

BACKGROUND

A common type of pumping unit used in oil well applications includes a downhole pump located in an underground reservoir, and connected to the surface by a string of sucker rods. A drive apparatus on the surface is connected to the top of the rod string and moves the rod string up and down in a reciprocating manner to drive the pump and pump fluid to the surface.

One common type of reciprocating drive for use with such pumping units is disclosed for example in U.S. Pat. No. 4,949,784 to Evans. The drive comprises a motor driving an eccentric arm to cause a pump am to move up and down, and the top end of the rod string is connected to the end of the pump arm.

It is also well known to use a hydraulic cylinder to cyclically extend and retract to reciprocate the rod string. U.S. Pat. Nos. 4,512,149 to Weaver and 4,761,120 to Mayer et al. disclose such a reciprocating drives where the hydraulic cylinders are oriented vertically, while U.S. Pat. No. 4,530,645 to Whatley et al. discloses such a reciprocating drives where the hydraulic cylinder is oriented horizontally.

A consideration when designing a reciprocating drive for such oil well pumping units is the need to move the drive apparatus away from the top of the well to provide access for service rigs to be set up over the well head to provide periodic maintenance such as is usually required on oil wells. Such maintenance often requires that a service rig be positioned to pull the rod string and the downhole pump out of the well. Considerable time and equipment is typically required to disassemble and/or move existing prior art drives sufficiently to allow the service rig to be set up in the required location.

SUMMARY OF THE INVENTION

It is an object of the present invention to provide a reciprocating drive apparatus for oil well pumps and the like that overcomes problems in the prior art.

In a first embodiment the present invention provides a reciprocating drive apparatus for connection to a top end of a rod string to drive a downhole pump located in a well. The apparatus comprises a plate adapted to be fastened to a top end of a well head assembly of the well, and a mast is attachable to the plate in a substantially vertical working position. A hydraulic cylinder is operatively connected to a source of pressurized hydraulic fluid and is attached to the mast such that when the mast is in the working position the hydraulic cylinder is oriented substantially vertically, and such that the hydraulic cylinder can extend and retract in response to a controller. A tether is adapted to be fixed to the well head at a fast end thereof and is adapted for attachment to the top end of the rod string at a second end thereof. The tether is configured such that the hydraulic cylinder engages the tether to move the second end of the tether up and down as the hydraulic cylinder extends and retracts.

In a second embodiment the present invention provides a reciprocating drive apparatus for connection to a top end of a rod string to drive a downhole pump located in a well. The apparatus comprises a plate adapted to be fastened to a top end of a well head assembly of the well. A mast comprises a pair of beams and is pivotally connected to the plate such that the mast can be moved from a substantially horizontal idle position to a substantially vertical working position. At least one fastener is operative to secure the mast in the working position. A hydraulic cylinder is operatively connected to a source of pressurized hydraulic fluid and has a barrel thereof attached to the beam and substantially in alignment with the beams such that a piston of the hydraulic cylinder extends and retracts from a top end of the barrel in response to a controller. A wheel member is rotatably attached to a top end of the piston about a substantially horizontal rotational axis. A tether is adapted to be fixed to the well head at a first end thereof, and extends upward over and engaging the wheel member, and then downward to a second end thereof adapted for attachment to the top end of the rod string.

In a third embodiment the present invention provides a reciprocating drive apparatus to drive a downhole pump located in a well. The apparatus comprises a plate fastened to a top end of a well head assembly of the well, and a mast pivotally connected to the plate such that the mast can be moved from a substantially horizontal idle position to a substantially vertical working position. At least one fastener is operative to secure the mast in the working position. A hydraulic cylinder is operatively connected to a source of pressurized hydraulic fluid, and is attached to the mast such that when the mast is in the working position the hydraulic cylinder is oriented substantially vertically, and such that the hydraulic cylinder can extend and retract in response to a controller. A tether is fixed to the well head at a first end thereof and is attached at a second end thereof to a top end of a rod string extending down the well to the downhole pump. The tether is configured such that the hydraulic cylinder engages the tether to move the top end of the rod string up and down as the hydraulic cylinder extends and retracts.

The apparatus is simple and economical, and can be scaled up down as required for particular applications. Generally it is contemplated that the apparatus of the invention will be used with about a 20-30 horsepower gas engine, running on natural gas from the well. Because of its economy, and the ease of installation, and the case of removal to allow access for well servicing, it is contemplated that many oil wells with small production can be profitably maintained in production.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
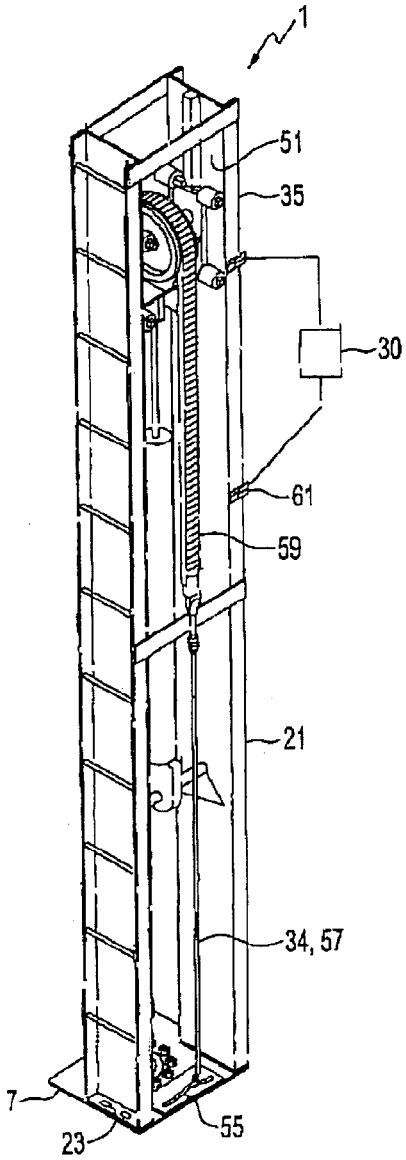
FIG. 1 is a schematic perspective rear view of an embodiment of a reciprocating drive apparatus of the present invention.
Figure 2:
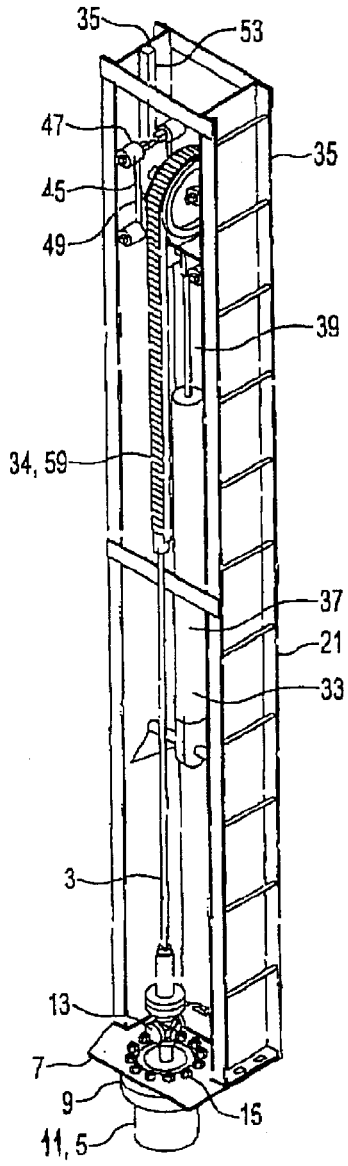
FIG. 2 is a schematic perspective front view of the embodiment of FIG. 1.
Figure 3:
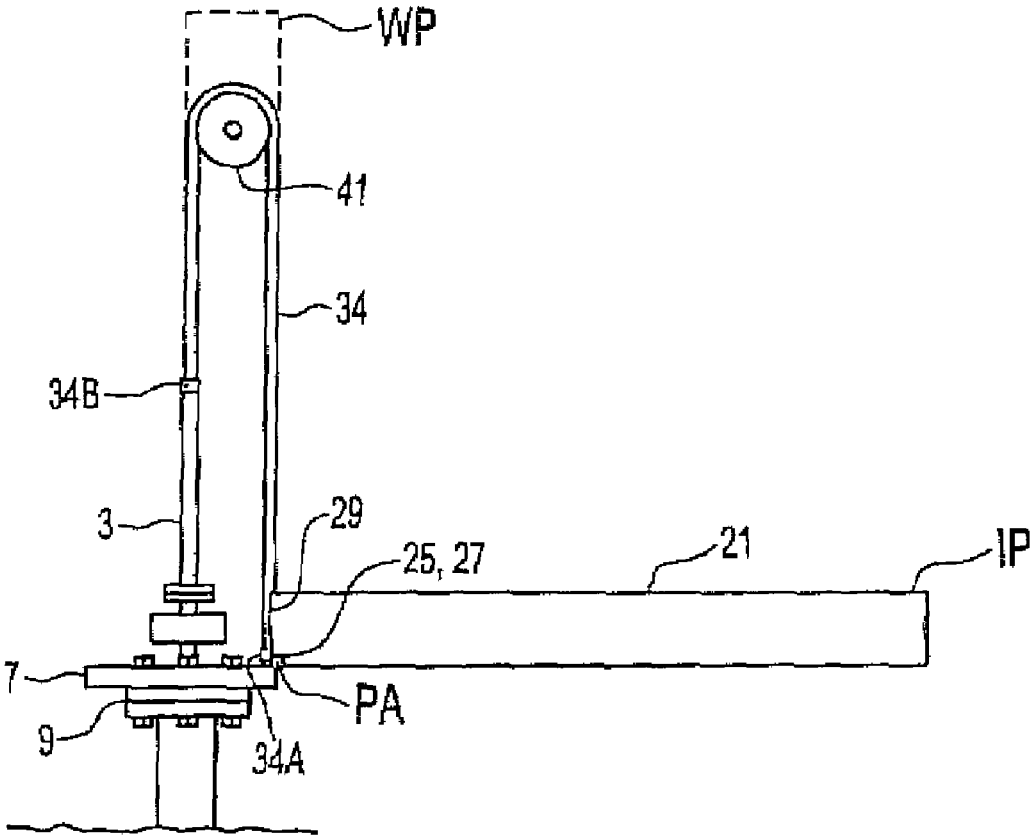
FIG. 3 is a schematic side view of the embodiment of FIG. 1.

FIGS. 1-3 illustrate a reciprocating drive apparatus 1 of the present invention for connection to a top end of a rod string 3 to drive a downhole pump located in a well 5. The apparatus 1 comprises a plate 7 adapted to be fastened to a top end of a well head assembly of the well 5. In the illustrated embodiment, the plate 7 is attached to the well head flange 9 at the top of the casing 11 of the well 5. The hardware 13 of the well head assembly, comprising valves and the like, is located above the plate 7.

Figure 4:
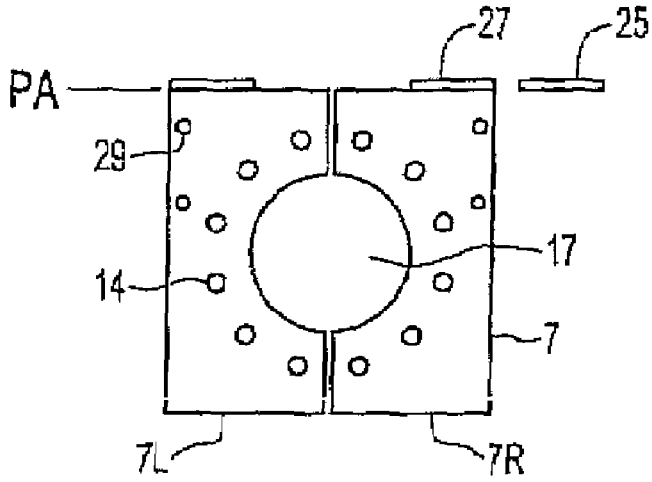
FIG. 4 is a top view of the plate of the embodiment of FIG. 1.

Also as illustrated in FIG. 4, the illustrated plate 7 comprises right and left sections 7R, 7L such that well head bolts 15 on a right side of the well head flange 9 can be removed and then replaced through flange bolt holes 14 in the plate section 7R to install the right section 7R, and then well head bolts 15 on a left side of the well head flange 9 can be removed and then replaced through flange bolt holes 14 in the plate section 7L to install the left section 7L. The plate 7 can thus be fastened to the well head flange 9 on existing wells without the need to disturb the hardware 13 of the well head assembly. Well tubing and the rod string 3 extend through the central aperture 17 in the plate 9.

A mast 21 is attached to the plate by fasteners such as bolts 23 such that the mast 21 is oriented in a substantially vertical working position as shown in FIGS. 1 and 2. While it is contemplated that the mast 21 could be raised and maneuvered into the required vertical working position on top of the plate 7 by a boom truck or like equipment, FIG. 3 illustrates the mast 21 pivotally connected to the plate 7 about a pivot axis PA.

When the plate 7 has been attached to the well head flange 9, the mast 21 can be connected by hinge pins 25 to hinges 27 welded to the plate 7 and the bottom of the mast 21 while lying down in a substantially horizontal idle position IP as illustrated in FIG. 3, and then raised to the substantially vertical working position WP by a boom truck or the like. The hinges 27 are configured such that once the mast 21 has been raised to the working position WP article, fastener apertures 29 in the bottom of the mast 21 are aligned with corresponding apertures 29 in the plate 7' and fasteners such as bolts 23 may be inserted to secure the mast 21 in the working position WP article.

The pivotal connection of the mast 21 to the plate 7 allows the mast 21 to be maneuvered to connect the hinges 27 while it is lying down, a substantially easier operation than maintaining the mast 21 upright while aligning the fastener apertures 29. Also, when in use, the pivotal connection of the hinges 27 allows the operator to simply remove the bolts 23 to lay the mast over to one side, or all the way down to rest on the ground, to allow access to the well head assembly for service rigs or the like. One the service is complete, the mast can be simply raised again to the working position WP article and the bolts 23 re-installed.

A hydraulic cylinder 33 is attached to the mast 21 and operatively connected to a source of pressurized hydraulic fluid. Typically the source will be provided by an engine driving a hydraulic pump, and will include appropriate valves and piping as is known in the art.

The hydraulic cylinder 33 is attached to the mast such that when the mast is in the working position WP article, the hydraulic cylinder 33 is oriented substantially vertically, and such that the hydraulic cylinder 33 can extend and retract in response to a controller 30. A tether 34 is fixed at a first end thereof 34A to the well head flange 9, or to some other convenient location fixed with respect to the ground such as the plate 7 or a lower portion of the mast 21. The opposite second end of the tether 34B is attached to the top end of the rod string 3. The tether 34 is configured such that the hydraulic cylinder 33 engages the tether 34 to move the second end 34 B of the tether 34, and thus the rod string 3, up and down as the hydraulic cylinder 33 extends and retracts.

In the illustrated embodiment the mast 21 comprises a pair of beams 35, and the barrel 37 of the hydraulic cylinder 33 is attached between the beams 35 and substantially in alignment with the beams 35. The piston 39 of the hydraulic cylinder 33 extends and retracts from a top end of the barrel 37. A wheel member 41 is rotatably attached to the top end of the piston 39 about a substantially horizontal rotational axis and engages a tether 34. Depending on the tether being used the wheel member 41 will typically be provided by a pulley, sprocket or like member appropriate to the tether 34.

In order to maintain the hydraulic cylinder 33 in alignment, a carriage 45 is attached to the top end of the piston 39. Carriage wheels 47 are mounted on opposite faces 49 of the carriage 45. The carriage rollers or wheels 47 roll up and down inner faces 51 of the beams 35, and recesses on the faces 49 of the carriage 45 engage corresponding ribs 53 extending from the inner faces 51 of the beams 35. The carriage 45 is thus movable up and down in a path maintained in alignment with the beams 35. The wheel member 41 is rotatably mounted to the carriage 45.

In the illustrated embodiment the first end 34A of the tether is fixed to the well head flange 9 by attachment to a tether bracket 55 bolted to the plate 7. A portion 57 of the illustrated tether 34 is provided by a cable that is passed through the tether bracket 55 and clamped. An upper end of the cable portion 57 is connected to a link chain portion 59 of the tether 34 that is configured to pass smoothly over a pulley providing the wheel member 41, and down to the second end 34B that is attached to the top end of the rod string 3.

The mast 21 and the plate 7 are configured such that when the second end 34B of the tether 34 is attached to the top end of the rod string 3 the tether 34 is oriented substantially vertically between the top end of the rod string 3 and the wheel member 41. The vertical configuration is seen in FIG. 3. Lateral stresses on the rod string 3 are avoided and the tether moves the rod string 3 vertically as the hydraulic cylinder moves the wheel member 41 vertically up and down.

The controller 30 includes upper and lower limit switches 61 configured such that at upper and lower ends of a stroke of the hydraulic cylinder 33, pressurized hydraulic fluid is directed to reverse a direction of travel of the piston 39. The stroke location on the mast 21, and the length of the stroke, can be set as desired by the operator. The hydraulic cylinder could be either a single or double acting cylindrical. Appropriate pump capacities, orifices, and the like will be provided to control the speed of the ascent and descent of the piston 39 to that satisfactory for driving the connected pump.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A reciprocating drive apparatus for connection to a top end of a rod string to drive a downhole pump located in a well, the apparatus comprising:

a plate adapted to be fastened to a top end of a well head assembly of the well;

a mast pivotally connected to the plate such that the mast can be moved from a substantially horizontal idle position to a substantially vertical working position;

a hydraulic cylinder operatively connected to a source of pressurized hydraulic fluid;

wherein the hydraulic cylinder is attached to the mast such that when the mast is in the working position the hydraulic cylinder is oriented substantially vertically, and such that the hydraulic cylinder can extend and retract in response to a controller;

a tether adapted to be fixed to the well head at a first end thereof and adapted for attachment to the top end of the rod string at a second end thereof;

wherein the tether is configured such that the hydraulic cylinder engages the tether to move the second end of the tether up and down as the hydraulic cylinder extends and retracts.

2. The apparatus of claim 1 wherein the mast comprises a pair of beams, and wherein the hydraulic cylinder is attached between the beams and substantially in alignment with the beams.

3. The apparatus of claim 2 wherein a barrel of the hydraulic cylinder is attached to the beams such that a piston of the hydraulic cylinder extends and retracts from a top end of the barrel, and comprising a wheel member rotatably attached to a top end of the piston about a substantially horizontal rotational axis and engaging the tether.

4. The apparatus of claim 3 wherein the first end of the tether is adapted to be fixed to the well head at a first end thereof by attachment to one of the plate and a lower portion of the mast, and extends upward over the wheel member and downward to the second end.

5. The apparatus of claim 4 wherein mast and the plate are configured such that when the second end of the tether is attached to the top end of the rod string the tether is oriented substantially vertically between the top end of the rod string and the wheel member.

6. The apparatus of claim 3 comprising a carriage attached to the top end of the piston and engaged in the beams such that the carriage is movable up and down in a path aligned with the beams, and wherein the wheel member is rotatably mounted to the carriage.

7. The apparatus of claim 3 wherein the controller includes upper and lower limit switches configured such that at upper and lower ends of a stroke of the hydraulic cylinder, pressurized hydraulic fluid is directed to reverse a direction of travel of the piston.

8. The apparatus of claim 1 wherein the plate comprises right and left sections such that well head bolts on a right side of the well head can be removed and then replaced to install the right section, and then well head bolts on a left side of the well head can be removed and then replaced to install the left section.

9. A reciprocating drive apparatus for connection to a top end of a rod string to drive a downhole pump located in a well, the apparatus comprising:

a plate adapted to be fastened to a top end of a well head assembly of the well;

a mast comprising a pair of beams, the mast pivotally connected to the plate such that the mast can be moved from a substantially horizontal idle position to a substantially vertical working position;

at least one fastener operative to secure the mast in the working position;

a hydraulic cylinder operatively connected to a source of pressurized hydraulic fluid and having a barrel thereof attached to the beams and substantially in alignment with the beams such that a piston of the hydraulic cylinder extends and retracts from a top end of the barrel in response to a controller;

a wheel member rotatably attached to a top end of the piston about a substantially horizontal rotational axis;

a tether adapted to be fixed to the well head at a first end thereof, extending upward over and engaging the wheel member, and then downward to a second end thereof adapted for attachment to the top end of the rod string.

10. The apparatus of claim 9 wherein the first end of the tether is adapted to be fixed to the well head at a first end thereof by attachment to one of the plate and a lower portion of the mast.

11. The apparatus of claim 10 wherein mast and the plate are configured such that when the second end of the tether is attached to the top end of the rod string the tether is oriented substantially vertically between the top end of the rod string and the wheel member.

12. The apparatus of claim 9 comprising a carriage attached to the top end of the piston and engaged in the beams such that the carriage is movable up and down in a path aligned with the beams, and wherein the wheel member is rotatably mounted to the carriage.

13. The apparatus of claim 9 wherein, the controller includes upper and lower limit switches configured such that at upper and lower ends of a stroke of the hydraulic cylinder, pressurized hydraulic fluid is directed to reverse a direction of travel of the piston.

14. The apparatus of claim 9 wherein the plate comprises right and left sections such that well head bolts on a right side of the well head can be removed and then replaced to install the right section, and then well head bolts on a left side of the well head can be removed and then replaced to install the left section.

15. A reciprocating drive apparatus to drive a downhole pump located in a well, the apparatus comprising:

a plate fastened to a top end of a well head assembly of the well;

a mast pivotally connected to the plate such that the mast can be moved from a substantially horizontal idle position to a substantially vertical working position;

at least one fastener operative to secure the mast in the working, position;

a hydraulic cylinder operatively connected to a source of pressurized hydraulic fluid;

wherein the hydraulic cylinder is attached to the mast such that when the mast is in the working position the hydraulic cylinder is oriented substantially vertically, and such that the hydraulic cylinder can extend and retract in response to a controller;

a tether fixed to the well head at a first end thereof and attached at a second end thereof to a top end of a rod string extending down the well to the downhole pump;

wherein the tether is configured such that the hydraulic cylinder engages the tether to move the top end of the rod string up and down as the hydraulic cylinder extends and retracts.

16. The apparatus of claim 15 wherein the mast comprises a pair of beams, and wherein a barrel of the hydraulic cylinder is attached between the beams and substantially in alignment with the beams such that a piston of the hydraulic cylinder extends and retracts from a top end of the barrel, and comprising a wheel member rotatably attached to a top end of the piston about a substantially horizontal rotational axis and engaging the tether.

17. The apparatus of claim 16 wherein the first end of the tether is fixed to the well head at a first end thereof by attachment to one of the plate and a lower portion of the mast, and extends upward over the wheel member and substantially vertically downward from the wheel member to the top end of the rod string.

18. The apparatus of claim 15 comprising a carriage attached to the top end of the piston and engaged in the beams such that the carriage is movable up and down in a path aligned with the beams, and wherein the wheel member is rotatably mounted to the carriage.

19. The apparatus of claim 15 wherein the controller includes upper and lower limit switches configured such that at upper and lower ends of a stroke of the hydraulic cylinder, pressurized hydraulic fluid is directed to reverse a direction of travel of the piston.

20. The apparatus of claim 15 wherein the plate comprises right and left sections.

* * * * *